US009319804B2

(12) United States Patent
Allegro-Baumann et al.

(10) Patent No.: US 9,319,804 B2
(45) Date of Patent: Apr. 19, 2016

(54) METHOD FOR OPERATING A HEARING DEVICE AS WELL AS A HEARING DEVICE

(75) Inventors: Silvia Allegro-Baumann, Unterageri (CH); Ralph Peter Derleth, Hinwil (CH); Siddhartha Jha, Ruti (CH)

(73) Assignee: SONOVA AG, Staefa (CH)

( * ) Notice: Subject to any disclaimer, the term of this patent is extended or adjusted under 35 U.S.C. 154(b) by 0 days.

(21) Appl. No.: 14/128,158

(22) PCT Filed: Jun. 23, 2011

(86) PCT No.: PCT/EP2011/060541

§ 371 (c)(1),
(2), (4) Date: Dec. 20, 2013

(87) PCT Pub. No.: WO2012/175134

PCT Pub. Date: Dec. 27, 2012

(65) Prior Publication Data

US 2014/0105435 A1 Apr. 17, 2014

(51) Int. Cl.
*H04R 25/00* (2006.01)
*G10L 21/0364* (2013.01)

(52) U.S. Cl.
CPC ..... *H04R 25/48* (2013.01); *G10L 21/0364* (2013.01); *H04R 25/353* (2013.01); *H04R 2225/43* (2013.01)

(58) Field of Classification Search
CPC ..... H04R 25/353; H04R 2225/43; H04R 25/505; H04R 25/554; H04R 25/356
USPC ..... 381/318, 316, 317
See application file for complete search history.

(56) References Cited

U.S. PATENT DOCUMENTS 7,248,711 B2 7/2007 Allegro et al.
2004/0175012 A1 * 9/2004 Roeck et al. ..... 381/317

FOREIGN PATENT DOCUMENTS

EP 1441562 A2 * 7/2004 ..... H04R 25/00
EP 1 686 566 A2 8/2006
EP 2 375 782 A1 10/2011
WO 2007/000161 A1 1/2007

OTHER PUBLICATIONS

Written Opinion for PCT/EP2011/060541 dated dated Apr. 10, 2012.
International Search Report for PCT/EP2011/060541 dated Apr. 10, 2012.

* cited by examiner

*Primary Examiner* — Davetta W Goins
*Assistant Examiner* — Phylesha Dabney
(74) *Attorney, Agent, or Firm* — Pearne & Gordon LLP

(57) ABSTRACT

A method for operating a hearing device by applying a frequency transposition scheme to an input signal of the hearing device comprising an input transducer, a signal processing unit and an output transducer, the method comprising the steps of transforming the input signal from time domain into frequency domain by applying a transformation function in order to obtain an input spectrum having a frequency range comprising a source region (20) and a destination region (30), adaptively selecting signal components of the source region (20) taking into account momentary characteristics of the input signal, transposing the selected signal components to the destination region (30), and supplying the output spectrum or a transformation thereof to the output transducer, the output spectrum comprising signal components of the destination region (30).

17 Claims, 7 Drawing Sheets

METHOD FOR OPERATING A HEARING DEVICE AS WELL AS A HEARING DEVICE

TECHNICAL FIELD OF THE INVENTION

The present invention is related to a method for operating a hearing device as well as to a hearing device.

DESCRIPTION OF THE RELATED ART

Various approaches for frequency lowering have been pursued in order that hearing impaired patients with high frequency hearing loss can benefit, especially in those cases where the amplification of the original high frequency sound is not useful—e.g. due to dead regions—or not possible—due to potential feedback problems on applying high gain or due to limited bandwidth of applied gain.

Known teachings describing frequency lowering schemes are disclosed in WO 2007/000161 A1, U.S. Pat. No. 7,248,711 B2 and in EP-1 686 566 A2, for example. The known teachings have one or several of the following disadvantages:

- vowels are distorted for cut-off frequencies below 1'500 Hz;
- the known transposition scheme often results in increased confusion for the hearing device user;
- distortions of harmonic relationships lead to an altered pitch perception and decrease the pleasure of listening music.

It is therefore one object of the present invention to overcome at least one of the above-mentioned disadvantages.

SUMMARY OF THE INVENTION

In the context of the present invention, the term "transposition" or "transpose" is defined as having at least one of the following meanings:

- a replacement of destination frequency components by source frequency components;
- any combination of destination frequency components with corresponding source frequency components.

Furthermore, the term "hearing device" is not only directed to hearing aids that are used to improve the hearing of hearing impaired patients but also to any communication device, be it wired or wireless, or to hearing protection device, wherein hearing aids may also be implantable.

The present invention is first directed to a method for operating a hearing device by applying a frequency transposition scheme to an input signal of the hearing device. The hearing device comprises an input transducer, a signal processing unit and an output transducer. The method according to the present invention comprises the steps of:

- transforming the input signal from time domain into frequency domain by applying a transformation function in order to obtain an input spectrum having a frequency range comprising a source region and a destination region,
- adaptively selecting signal components of the source region taking into account momentary characteristics of the input signal,
- transposing the selected signal components to the destination region, and
- supplying an output spectrum or a transformation thereof to the output transducer, the output spectrum comprising signal components of the destination region.

In a more specific embodiment of the present invention, the momentary characteristic is at least one of the following:

- an auditory expectation of the user of the hearing device;
- a momentary energy distribution in the source region, in particular the momentary energy distribution of phonemes in the source region;
- a momentary energy distribution in the destination region;
- a perturbation signal being present in the input signal.

In further embodiments of the present invention, the source region comprises a lower source region and at least two source stacks, the lower source region being below a cut-off frequency and the at least two source stacks being above the cut-off frequency, and wherein the destination region comprises a lower destination region and a destination stack, the lower destination region being below the cut-off frequency and the destination stack being above the cut-off frequency, the cut-off frequency particularly being below 1'500 Hz.

In further embodiments of the present invention, the step of transposing comprises the following steps:

- determining a center frequency bin lying within the source region, a spectral energy being maximal at the center frequency bin, and
- transposing frequency bins equally distributed around the center frequency bin to the destination region.

In still further embodiments of the present invention, the source region above the cut-off frequency is divided into equally sized source stacks, each having a frequency range that is equal to a frequency range of the destination stack.

In further embodiments of the present invention, the step of transposing comprises one of the following steps:

- transposing frequency bins of the source stacks to corresponding frequency bins of the destination stack, the frequency bin being transposed having maximum energy of all corresponding frequency bins of the source stacks;
- transposing all frequency bins of one of the source stacks to the destination stack, the transposed source stack comprising a frequency bin having maximum energy;
- transposing all frequency bins of one of the source stacks to the destination stack, the transposed source stack comprising a maximum energy sum over its frequency bins;
- transposing all frequency bins of one of the source stacks to the destination stack, the transposed source stack preserving a maximum spectral contrast.

Further embodiments of the present invention comprise the step of applying a pre-weighting function to signal components of the source region before the step of adaptively selecting signal components of the source region.

In further embodiments of the present invention, the pre-weighting function is based on at least one of the following criterions:

- an auditory expectation of the user of the hearing device;
- a momentary energy distribution in the source region;
- a momentary energy distribution in the destination region;
- a perturbation signal being present in the input signal.

Further embodiments of the present invention comprise the step of applying a post-weighting function to the destination region after the step of transposing the selected signal components.

In further embodiments of the present invention, the steps of selecting and transposing comprise a peak picking according to the following scheme:

$$i=\arg\max\,[w(n)\cdot F_{in}(n), w(n+j)\cdot F_{in}(n+j), w(n+j+1)\cdot F_{in}(n+j+1), \ldots, w(n+j+k)\cdot F_{in}(n+j+k)]$$

$$F_{out}(n)=w''(i)\cdot F_{in}(i)$$

wherein $F_{out}(n)$ is the output of the peak selection scheme for a given frequency bin with index n;

w(n) is the value of a pre-weighting function for the $n^{th}$ frequency bin;

w"(i) is the value of a post-weighting function for index i, used to weight the value of the transposed bin in destination region;

argmax [ . . . ] denotes the bin index for which the expression within [ ] is maximum; and $F_{in}(n)$ is the input magnitude for a frequency bin n.

In further embodiments of the present invention, the frequency transposition scheme is defined by the following formula:

$$F_k = \frac{C_R \cdot FC - F_{HL}}{C_R - 1}$$

wherein $C_R$ is the compression ratio in a second source stack of two source stacks;

FC corresponds to logarithm of the cut-off frequency defined between a lower source region and first source stack;

$F_{HL}$ corresponds to logarithm of an upper frequency being the lowest frequency of the second source stack; and $F_k$ corresponds to logarithm of a start frequency being defined as point of intersection between a one-to-one mapping of frequency components in the lower source region and an extension of the compressive mapping of the second source stack.

Furthermore, the present invention is also directed to a hearing device comprising:

an input transducer, an output transducer, a signal processing unit being operatively connected to the input transducer as well as to the output transducer, means for transforming the input signal from time domain into frequency domain by applying a transformation function in order to obtain an input spectrum having a frequency range comprising a source region and a destination region, means for adaptively selecting signal components of the source region taking into account momentary characteristics of the input signal, means for transposing the selected signal components to the destination region, and means for supplying the output spectrum or a transformation thereof to the output transducer, the output spectrum comprising signal components of the destination region.

In a more specific embodiment of the present invention, the momentary characteristic is at least one of the following:

an auditory expectation of the user of the hearing device;

a momentary energy distribution in the source region, in particular the momentary energy distribution of phonemes in the source region;

a momentary energy distribution in the destination region;

a perturbation signal being present in the input signal.

In further embodiments of the present invention, the source region comprises a lower source region and at least two source stacks, the lower source region being below a cut-off frequency and the at least two source stacks being above the cut-off frequency, and wherein the destination region comprises a lower destination region and a destination stack, the lower destination region being below the cut-off frequency and the destination stack being above the cut-off frequency, the cut-off frequency particularly being below 1'500 Hz.

In still further embodiments of the present invention, the means for transposing comprise the following:

means for determining a center frequency bin lying within the source region, a spectral energy being maximal at the center frequency bin, and means for transposing frequency bins equally distributed around the center frequency bin to the destination region.

In further embodiments of the present invention, the source region above the cut-off frequency is divided into equally sized source stacks, each having a frequency range that is equal to a frequency range of the destination stack.

In further embodiments of the present invention, the means for transposing comprise one of the following:

means for transposing frequency bins of the source stacks to corresponding frequency bins of the destination stack, the frequency bin having maximum energy of all corresponding frequency bins of the source stacks;

means for transposing all frequency bins of one of the source stacks to the destination stack, the transposed source stack comprising a frequency bin having maximum energy;

means for transposing all frequency bins of one of the source stacks to the destination stack, the transposed source stack comprising a maximum energy sum over its frequency bins;

means for transposing all frequency bins of one of the source stacks to the destination stack, the transposed source stack preserving a maximum spectral contrast.

Further embodiments of the present invention comprise means for applying a pre-weighting function to signal components of the source region before adaptively selecting signal components of the source region.

Further embodiments of the present invention comprise means for applying a post-weighting function to the destination region after transposing the selected signal components.

It is expressly pointed out that the above-mentioned embodiments can be arbitrarily combined. Only those combinations are excluded that would result in a contradiction.

BRIEF DESCRIPTION OF THE DRAWINGS

The present invention is further illustrated by way of exemplified embodiments shown in drawings and described in detail. It is pointed out that these embodiments are for illustrative purposes only and shall not confine the present invention.

DETAILED DESCRIPTION OF THE INVENTION

Figure 1:
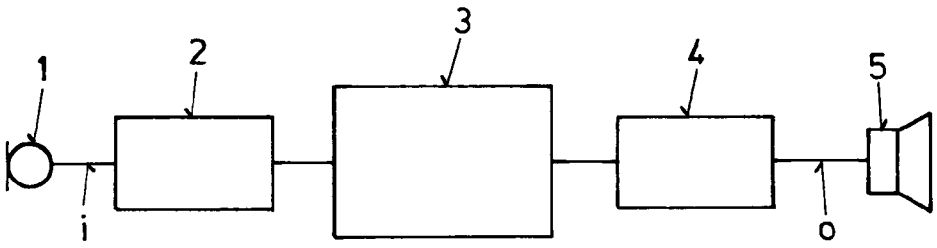
FIG. 1 shows a block diagram of a hearing device with its main components.

In FIG. 1, a hearing device is depicted comprising an input transducer 1, such as a microphone, an analog-to-digital converter 2, a signal processing unit 3, a digital-to-analog converter 4 and an output transducer 5, which is also called receiver or loudspeaker. For example, a hearing device is used to restore or to improve the hearing of a hearing impaired person in that a sound signal is picked up by the input transducer 1 and converted to an input signal i. In case of a digital hearing device, the analog-to-digital converter 2 generates a corresponding digital input signal that can now be processed by the signal processing unit 3, in which an output signal is calculated taking into account the hearing impairment of the user. This output signal o is fed, in case of the digital hearing device via the digital-to-analog converter 4, to the output transducer 5.

In case a signal processing algorithm, which is implemented in the signal processing unit 3, is applied in the frequency domain, a transformation function, such as a Fast Fourier Transformation (FFT), is used to transform the input signal i from the time domain into the frequency domain. Consequently, an inverse transformation function must be applied in order to transform an output spectrum into the time domain after implementing the signal processing algorithm. Instead of a Fourier transformation function and its inverse function, any other transformation function may be implemented, such as a Hadamard, a Paley or Slant transformation.

In particular, the present invention is directed to a signal processing algorithm (also called frequency transposition scheme) that is implemented in the signal processing unit 3. By the frequency transposition scheme, selected frequency ranges, which are important for a user of the hearing device but in which frequency ranges the user is not able to perceive an acoustic signal due to a complete hearing loss, for example, are transposed to another frequency range in which the hearing device user can perceive an acoustic signal.

Figure 2:
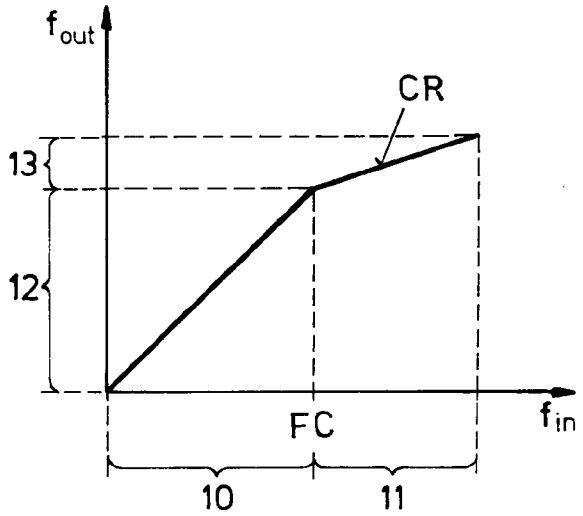
FIG. 2 shows a graph illustrating a known transposition scheme.

FIG. 2 depicts a known approach with a mapping between the input frequencies $f_{in}$ and the output frequencies $f_{out}$ for different spectral regions defined by a cut-off frequency FC and a compression ratio CR. While below the cut-off frequency FC no change occurs to the signal, a non-linear transposition takes place above the cut-off frequency FC by the compression ratio CR. One of the main limitations of this non-linear frequency compression algorithm is that the cut-off frequency FC is limited on the lower side to 1'500 Hz. This means that the hearing device user having a profound hearing loss above 1'500 Hz is not going to benefit from known frequency transposition algorithms. This is because transposing frequency components to lower frequencies than the cut-off frequency FC of 1'500 Hz results in distortions of vowels and non-fricative sounds which have a strong formant structure in frequency region below 1'500 Hz. The information, which is otherwise available undistorted to the hearing impaired, gets distorted by the known frequency transposition algorithm on lowering the cut-off frequency below 1'500 Hz. Such a behavior is unacceptable as it would be a barrier to initial acceptance of the processed sound by the hearing impaired user who is already used to hearing the vowels in a "close to normal" way.

Furthermore, known frequency transposition algorithms distort the harmonic structure of the input sound. Therefore, it is also not very useful for transposing music where it introduces unpleasant pitch distortions.

In connection with known frequency transposition schemes, it has been pointed out that the cut-off frequency FC must be equal or larger than 1'500 Hz in order not to distort vowels and non-fricative sounds which have a strong formant structure in a frequency region below 1'500 Hz. Therefore, signal components below the cut-off frequency FC are not changed, i.e. a so called lower source region 10 on the x-axis is linearly transposed to a lower target region 12 on the y-axis (one-to-one mapping). Above the cut-off frequency FC, a non-linear transposition is implemented in that—provided a logarithmic scale is used on the x—as well as on the y-axis—signal components of a so called higher source region 11 are transposed to a higher target region 13 that has a smaller bandwidth than the higher source region 11. The known technique does not enable a hearing impaired person to benefit from a frequency lowering algorithm having a cut-off frequency FC below 1'500 Hz, while offering acceptable sound quality and minimal distortion of vowels and non transposed sounds, which are otherwise audible without much distortion.

The present invention comprises a new frequency transposition scheme by adaptively selecting signal components of a source region taking into account momentary characteristics of the input signal.

A momentary characteristic of the input signal may be one or several of the following characteristic:

- an auditory expectation of a user of the hearing device;
- a momentary energy distribution in the source region, in particular the momentary energy distribution of phonemes in the source region;
- a momentary energy distribution in the destination region;
- a perturbation signal being present in the input signal.

With regard to the presence of a perturbation signal, it is pointed out that if a perturbation signal is detected, the frequency range, in which the perturbation signal is present, can be excluded from being transposed to a destination region. Therewith, the destination region will contain less disturbing signal components for the hearing device user.

In further embodiments of the present invention, a so called frequency stacking algorithm is implemented.

Figure 3:
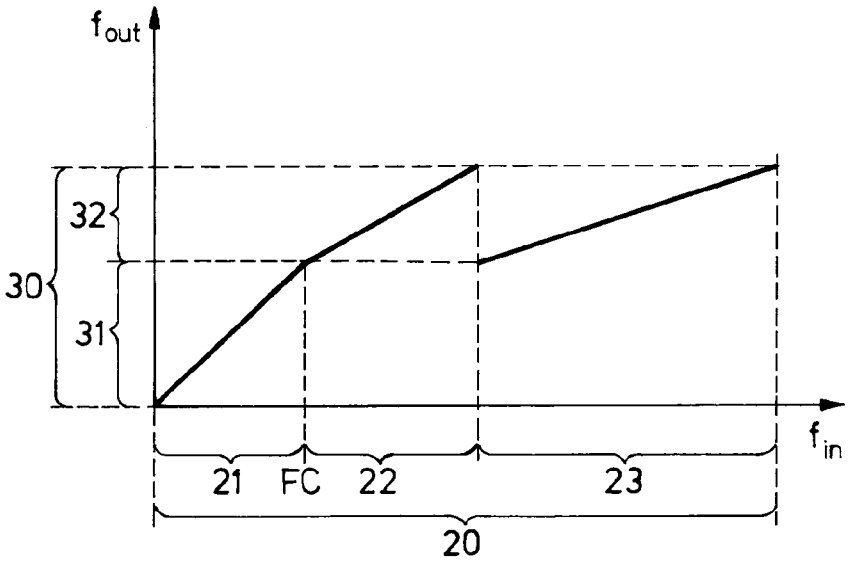
FIG. 3 shows a graph illustrating a first embodiment of the inventive frequency transposition scheme.

FIG. 3 illustrates a basic concept of the frequency stacking algorithm. On the horizontal axis of the graph shown in FIG. 3, an input frequency $f_{in}$ is indicated while an output frequency $f_{out}$ is indicated on the vertical axis of the graph. A source region 20 on the x-axis comprises a lower source region 21 and two source stacks 22 and 23, the lower source region 21 comprising frequencies up to a cut-off frequency FC, and the two source stacks 22, 23 comprising frequencies above the cut-off frequency FC. As depicted in FIG. 3, the first source stack 22 starts at the cut-off frequency FC, the second source stack 23 immediately follows the first source stack 22.

A destination region 30 on the y-axis comprises a lower destination region 31 and a destination stack 32, the lower destination region 31 comprising frequencies up to the cut-off frequency FC, and the destination stack 32 comprising frequencies above the cut-off frequency FC.

As can be seen from FIG. 3, the transposition scheme is such that signal components having frequencies in the lower source region 21 are mapped in a one-to-one mapping (also called linear transposition) to the lower destination region 31. Furthermore, signal components having frequencies in the first source stack 22 as well in the second source stack 23 are transposed to the destination stack 32. The manner how the transposition scheme is implemented, i.e. which signal components and at what frequency, will be further explained in connection with more specific embodiments.

If a frequency range of a source region being transposed is equal to a frequency range of a destination region, this is called linear frequency transposition. If, on the other hand, a frequency range of a source region being transposed is greater than a frequency range of a destination region, this is called compressive frequency transposition.

As a result of these definitions, FIG. 3 shows compressive transpositions for the transposition of the first source stack 22 to the destination stack 32, as well as for the transposition of the second source stack 23 to the destination stack 32.

Figure 4:
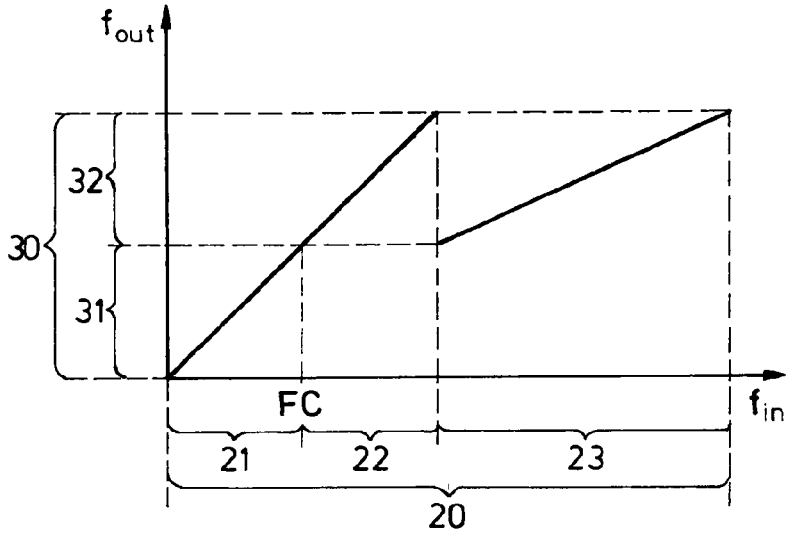
FIG. 4 shows a further graph illustrating a second embodiment of the inventive frequency transposition scheme.

In contrast thereto, FIG. 4 shows an embodiment of a transposition scheme which comprises a linear frequency transposition for signal components of the first source stack 22 to the destination stack 32. The second source stack 23, as in FIG. 3, is again a compressive frequency transposition.

It is pointed out that the inventive frequency transposition scheme is very flexible in that source stacks 22 and 23 may be of any size, in particular the source stack 23 may have a larger frequency range than the one of the source stack 22.

Figure 5:
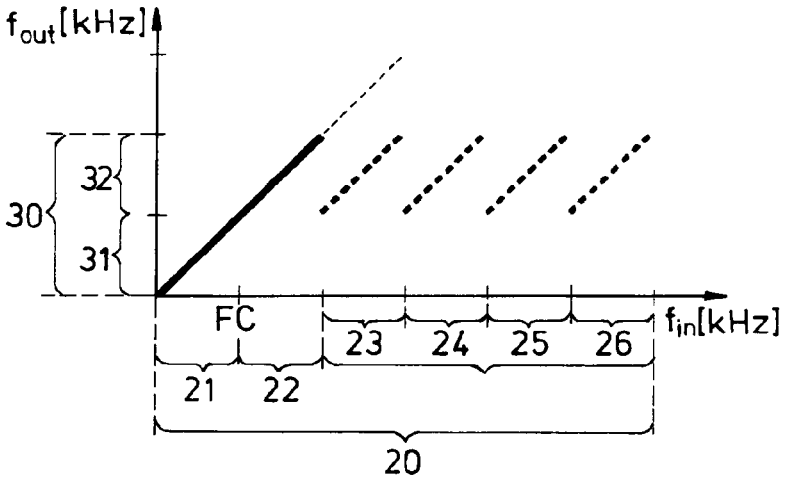
FIG. 5 shows a still further graph illustrating a third embodiment of the inventive frequency transposition scheme.

FIG. 5 shows a graph representing a further embodiment of the present invention. In contrast to the embodiment of FIGS. 3 and 4, the embodiment of FIG. 5 comprises five source stacks 22 to 26. All source stacks 22 to 26 have the same frequency range that is equal to the frequency range of the destination stack 32. Accordingly, every source stack 22 to 26 is linearly transposed, if at all or according to a specific transposition scheme, to the destination stack 32.

As more than one source stacks 22 to 26 are transposed to the same destination stack 32, a yet to be described frequency transposition scheme must be applied in order to obtain a good result in the output frequency range $f_{out}$, i.e. in the destination region 30, for the hearing device user.

In a specific embodiment of the present invention, the source stacks 22 to 26 have the same size. In other specific embodiments of the present invention, the size of the destination stack 32 and the source stacks 22 to 26 is equal to the bandwidth of the lower destination region 31, namely defined by the cut-off frequency FC.

According to one embodiment of the present invention, one of the source stacks 22 to 26 is selected and transposed to the destination stack 32 by replacing the original frequency content in the destination stack 32 by the frequency content of the selected source stack 22 to 26.

According to a further embodiment of the present invention, one of the source stacks 22 to 26 is selected and transposed to the destination stack 32 by combining the original frequency content in the destination stack 32 and the frequency content of the selected source stack 22 to 26.

According to a still further embodiment of the present invention, a stack-sized frequency area formed out of the source stacks 22 to 26 is selected and transposed to the destination stack 32 by replacing the original frequency content in the destination stack 32 by the frequency content of the newly formed stack-sized frequency area.

According to yet another embodiment of the present invention, a stack-sized frequency area formed out of the source stacks 22 to 26 is selected and transposed to the destination stack 32 by combining the original frequency content in the destination stack 32 with the frequency content of the newly formed stack-sized frequency area.

Generally and particularly regarding the above-mentioned embodiments, frequency components below the cut-off frequency FC remain unchanged.

The frequency stacking algorithm can be generalized, for example, by choosing source and destination stack sizes as a function of the bandwidth defined by the cut-off frequency FC instead of being equal to it. For example, the bandwidth of the source and destination stack sizes may be defined by 0.7, 1.5 or 2 times the cut-off frequency FC.

The combination of frequency content of the source stack or source stacks 22 to 26 with those in the destination stack 32 is done, for example, with a peak picking algorithm.

The frequency stacking algorithm also provides a frequency transposition scheme framework, in which intelligent adaptive frequency transposition can be conveniently implemented and in which most significant spectral segments can be specifically targeted for transposition. For example, such frameworks are described in connection with FIGS. 6 to 9.

Figure 6:
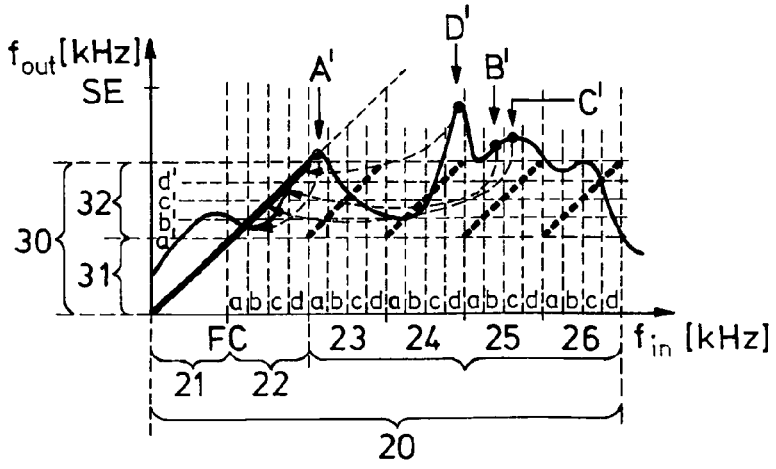
FIG. 6 shows another graph illustrating a fourth embodiment of the inventive frequency transposition scheme comprising spectral energy distribution as transposition criterion.

In connection with FIG. 6, a static frequency stacking algorithm is described. FIG. 6 again shows a graph depicting the relationship between the input frequency $f_{in}$ and the output frequency $f_{out}$. In addition, an indication of the spectral energy SE is also given on the y-axis of the graph shown in FIG. 6.

In the static frequency stacking algorithm, with x being a frequency bin and $x \in [1, \ldots, \text{stack size}]$, each $x^{th}$ frequency bin of the destination stack 32 is replaced by the maximum of the corresponding $x^{th}$ frequency bins of all predefined source stacks 22 to 26. It is noted that in this frequency stacking algorithm the magnitude order of the frequency bins in the destination stack 32 is not necessarily the same as in the original frequency bins in the source region 20. However, this can be managed to a certain extent by applying a weighting function (that is yet to be described) before a transposition step together with a peak picking algorithm to choose between the corresponding frequency bins of the source stacks.

FIG. 6 illustrates this stacking algorithm where the output frequency bins (i.e. the destination stack frequency bins) are indicated as a', b', c' and d'. The output frequency bin a' becomes the maximum spectral energy SE of all input frequency bins a of the source stack 22 to 26. Correspondingly, the same applies for the output frequency bins b', c' and d'.

In the example of FIG. 6, the spectral energy SE of the input frequency bin a of the second source stack 23 is greater than each spectral energy of the input frequency bin a of the source stacks 22 to 26. Therefore, the spectral energy SE of the output frequency bin a' becomes equal to the spectral energy SE of the input frequency bin a of the second source stack 23. This is indicated by an arrow A' in FIG. 6.

The values for the spectral energy SE at the output frequency bins b', c' and d' are calculated similarly. Accordingly, the value for the spectral energy SE at the output frequency b' is equal to the value for the spectral energy SE at the input frequency bin b of the fourth source stack 25 (arrow B' in FIG. 6). Furthermore, the value for the spectral energy SE at the output frequency c' is equal to the value for the spectral energy SE at the input frequency bin c of the fourth source stack 25 (arrow C' in FIG. 6). Finally, the value for the spectral energy SE at the output frequency d' is equal to the value for the spectral energy SE at the input frequency bin d of the third source stack 24 (arrow D' in FIG. 6).

Figure 7:
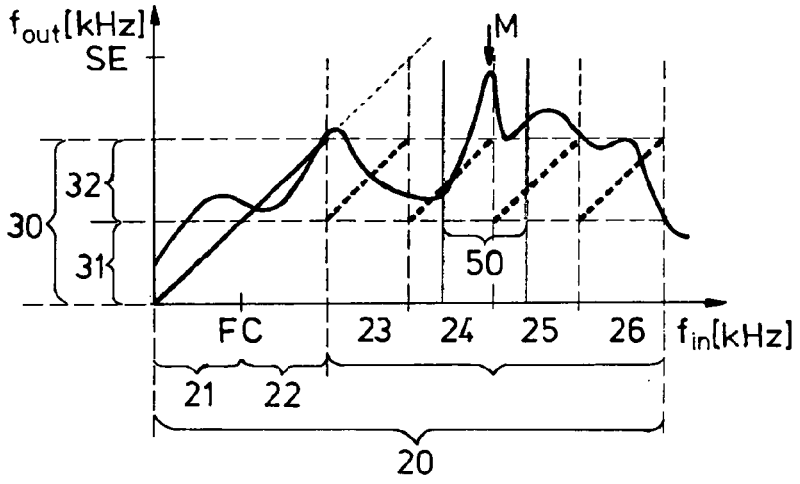
FIG. 7 shows a graph illustrating a fifth embodiment of the inventive frequency transposition scheme also comprising spectral energy distribution as transposition criterion.
Figure 8:
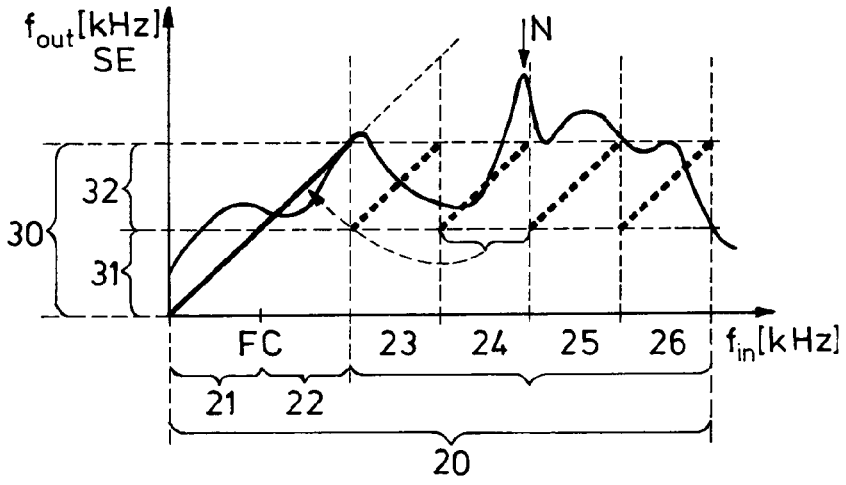
FIG. 8 shows another graph illustrating a sixth embodiment of the inventive frequency transposition scheme also comprising spectral energy distribution as transposition criterion.
Figure 9:
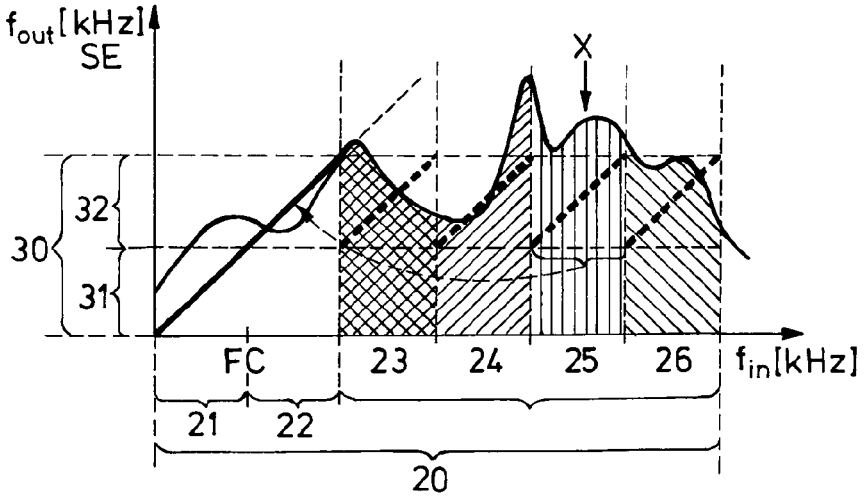
FIG. 9 shows a further graph illustrating a seventh embodiment of the inventive frequency transposition scheme also comprising spectral energy distribution as transposition criterion.

In FIGS. 7 to 9, several dynamic frequency stacking algorithms are illustrated. In a dynamic frequency stacking algorithm, a source stack to be transposed is selected or determined dynamically, i.e. on a frame per frame basis.

In one embodiment, a source stack 50 is defined around a maximum frequency bin (also called center frequency bin) lying within a stack frequency range comprising all source stacks 22 to 26, for example, the center frequency having maximum spectral energy. In FIG. 7, an arrow M is pointing to the maximum frequency bin. The frequency bin of the stack frequency range being equally distributed around the center frequency are transposed to the destination stack 32, i.e. the stack to be transposed is dynamically designed around the maximum energy frequency bin within the stack frequency range (i.e. within all source stacks 22 to 26) with this maximum energy frequency bin being in the center of the stack 50 to be transposed. It is noted that—while the bandwidth of the dynamically defined source stack 50 to be transposed is constant—its frequency location varies over time and does not necessarily correspond to one of the predefined source stacks 22 to 26. This approach is advantageous in that the search for the highest intensity peak is done in a wide frequency range.

In a further embodiment, a source stack to be transposed is equal to one of the predefined source stacks 22 to 26. The source stack to be transposed comprises the frequency bin having the maximum spectral energy. As can be seen from FIG. 8, the frequency bin having maximum spectral energy (arrow N in FIG. 8) lies within the source stack 24. Therefore, the source stack 24 is selected for the transposition to the destination stack 32. One advantage of this embodiment is a more faithful time alignment of transposed information, across successive frames.

In a still further embodiment, one of the source stacks is selected and transposed to the destination stack. Thereto, the overall energy of the frequency bins pertaining to the same source stack is calculated for each of the predefined source stacks. The predefined source stack with the highest energy sum is then transposed to the destination stack. This is further illustrated in FIG. 9, wherein source stack 25 has the highest energy sum (largest area below the graph and indicated by arrow x). Accordingly, the source stack 25 as a whole is transposed to the destination stack 32.

Yet another possible embodiment of a transposition scheme is one that selects the source stack preserving the maximum spectral contrast.

The present invention offers the opportunity for more intelligent signal processing in a frequency transposition scheme and opens the possibility of a more targeted frequency transposition. This allows for reducing the frequency transposition edge below what is possible with known techniques. It prevents the distortion of vowels which are seen to occur with known transposition schemes on using very low cut-off frequencies FC. The frequency stacking framework in the frequency domain also allows for adaptive frequency transposition by lowering perceptually significant, contiguous chunks of spectral segments or stacks above the cut-off frequency FC. In this respect, the dynamic stacking approaches described herein outperform all known frequency transposition techniques.

The peak picking algorithm, when used in conjunction with a weighting function (yet to be described) and the frequency stacking scheme, allows a convenient second degree of control on what can be transposed, thus allowing for "biased" and "adaptive" frequency transposition for the first time. Such a possibility did not exist, particularly not in known non-linear frequency compression schemes.

The weighting function (also called expectation bias) is used to adaptively choose (or select) different parts of the input spectrum to transpose to the destination region. The spectral energy magnitudes are multiplied by the weights of the weighting function and this weighted spectrum is used to select a particular source stack. Un-weighted signal components of the selected source stack are then processed further i.e. transposed to the corresponding destination stack.

The weighting function or the expectation bias function weights the input spectrum in such a way that the already available low frequency information is given more significance. If a frequency transposition scheme then selects the most important information from a given source region to be transposed to a destination region, auditory expectations are respected more and information is transposed only if it is considerably significant in comparison to what is already accessible to the hearing impaired user in the lower frequencies or destination region.

An advantage of using a weighting function is that an adaptive lowering can be accomplished without any explicit real time detection of phonemes themselves. This is accomplished by a careful choice of weights and by exploiting the fact that fricatives have proportionally much larger energy in the higher frequencies compared to vowels. This keeps the vowels from getting distorted while still lowering high frequency information in fricatives.

The weighting by the weighting function w and the transposition of the source region to the destination region will be explained in detail along with FIGS. 10 to 15 which show several acoustic situations.

The speech spectral energy of a human being is distributed across different frequency bands with the difference in distribution corresponding to the different phonemes: vowels, consonants, fricatives, etc. For a given hearing loss with dead regions, i.e. with frequency bands wherein no acoustic perception is possible, high frequency components pertaining in such dead regions (also called source regions hereinafter) are transposed to or shifted to frequency region (also called destination regions hereinafter), in which acoustic perception is still possible. According to the present invention, the destination region is determined, for example, by the hearing loss itself. However, the source region, i.e. important acoustic information that lies in the inaccessible high frequency range, is not fixed but varies with phonemes.

According to the present invention, an adaptive frequency transposition scheme is proposed which reaches a decision for a given spectral energy distribution in the input spectrum. The decision involves choosing the best source frequency range from where energy needs to be transposed to the destination region, and whether to transpose anything at all depending on the energy distribution in the destination region.

Therewith, it is ascertained that the new synthesized sound is as close to the otherwise previously accessible sound to the hearing impaired, or in other words respects the auditory expectations of the hearing impaired user in the best possible way, while still making available the maximum possible new information for enhanced speech comprehension.

Therewith, the present invention helps to minimize initial objections of a hearing device user and helps to reduce acclimatization to the new algorithm. Furthermore, the present invention is a simple solution that can be implemented, for example, by a spectral weighting function to be described below.

The destination region of the frequency transposition scheme can be defined by taking into account a given hearing loss of the user of the hearing device. The source region is assumed to be variable depending on the energy/information distribution, in particular resulting of phonemes. Once the source region and the destination region or destination regions are specified, a comparison/selection scheme being an adaptive algorithm itself is used to choose and process the transposed signal for perceptual benefits. A selective processing may be, for example, a loudness scaling to preserve naturalness of the lowered speech with respect to phonemes/vowels that are only affected in a minor manor by the frequency transposition scheme.

According to one embodiment of the present invention, it is proposed to use a weighting function (also called expectation bias) to adaptively choose or select different parts of the input spectrum to transpose to the same destination region. The spectral energy magnitudes are multiplied by the weights of the weighting function w and this weighted spectrum is used to by a frequency transposition scheme for further processing. In a further embodiment of the present invention, the weighting function w is only applied in order to select a source region. The step of transposing the selected source region is applied to the un-weighted spectrum.

The weighting function w or the expectation bias function weights the input spectrum in such a way that the already available low frequency information is given more significance. If a frequency transposition scheme then selects the most important information from a given source region to be transposed to a destination region, auditory expectations are respected more and information is transposed only if it is considerably significant in comparison to what is already accessible to the hearing impaired user in the lower frequencies or destination region.

An advantage of using a weighting function w is that an adaptive lowering can be accomplished without any explicit real time detection of phonemes themselves. This is accomplished by a careful choice of weights and by exploiting the fact that fricatives have proportionally much larger energy in the higher frequencies compared to vowels. This keeps the vowels from getting distorted while still lowering high frequency information in fricatives.

In principle the present invention can be extended for a low frequency hearing loss as well—although a low frequency hearing loss is rare but still well known—, where the auditory expectation bias or weighting function w is derived from accessible high frequencies.

In FIGS. 10 to 15, three different spectral contours are depicted with three different kinds of phonemes to further illustrate the present invention.

Figure 10:
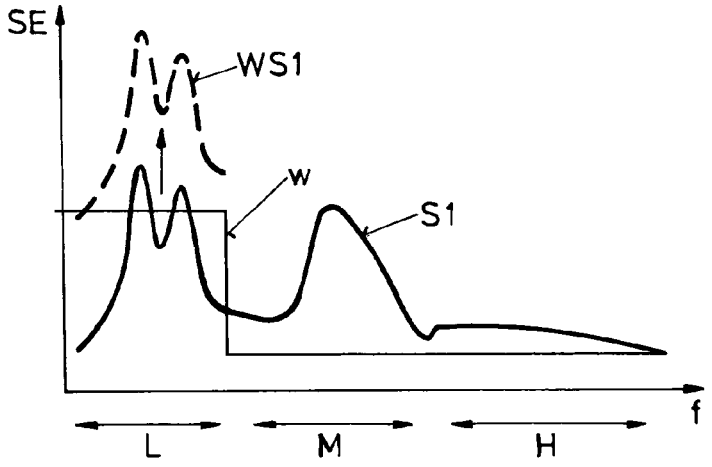
FIG. 10 shows a first spectral contour containing low frequency information in vowels that become more significant after applying of a weighting function.
Figure 11:
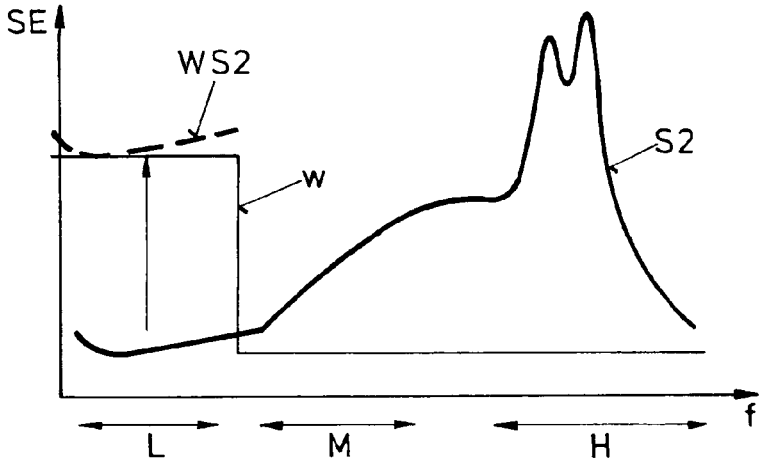
FIG. 11 shows a second spectral contour containing high frequency fricative information that is selected for frequency transposition even after applying the weighting function of FIG. 10.
Figure 12:
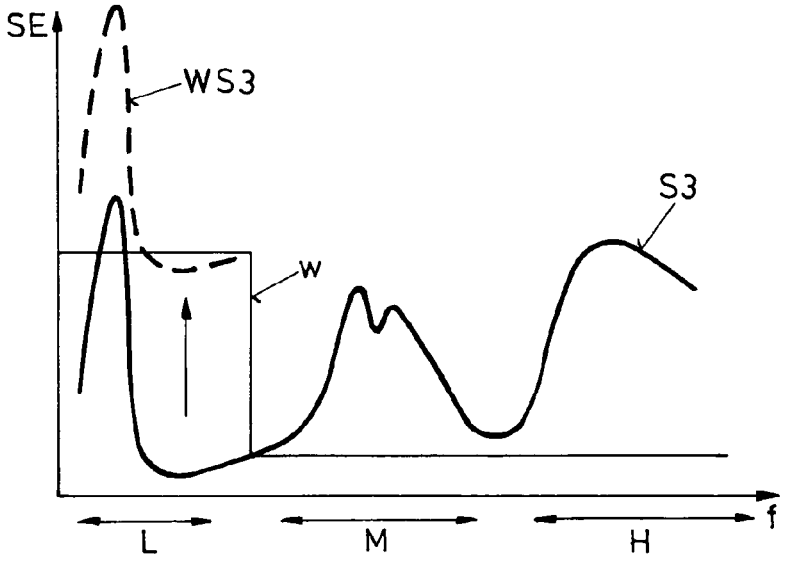
FIG. 12 shows a third spectral contour containing low frequency information, to which contour the same weighting function is applied as shown in FIGS. 10 and 11.

As can be seen from FIGS. 10 to 15, the frequency axis has been roughly divided into three sections: a low frequency section L, a mid frequency region M and high frequency region H for illustration's sake. The FIGS. 10 to 12 are meant to illustrate the weighting technique, and the edge frequencies of these regions are therefore not exactly indicated. In one embodiment, the edges are aligned to the edges of the source stacks 22 to 26 (FIGS. 3 to 9), for example.

The diagram of FIG. 10 shows a spectral contour S1 of a vowel like phoneme, wherein the x-axis represents the frequency f. The spectral contour S1 is overlaid by a spectral weighting function w (also called expectation bias). The y-axis represents the spectral energy SE and is assumed to be logarithmic so that the multiplication of the weighting function w with the spectral contour S1 results in an addition according to the well known formula:

$$\log(w*x)=\log w+\log x$$

Applying the weighting function w to the first spectral contour S1 therefore results in a selection for transposition of the corresponding spectral section (in FIG. 10 of the low frequency section L) on the y-axis. The dashed line in FIG. 10 represents the weighted spectral contour WS1 obtained by the multiplication of the first spectral contour S1 by the weighting function w. In FIG. 10, the low frequency section L of the first spectral contour S1 gets weighted and consequently shifted upwards, whereas the mid frequency section M and the high frequency section H are weighted with 1 (default weighting, log(1)=0) and are therefore not shifted.

The weighting function w of FIG. 10 is supposed to protect low frequency vowels from getting corrupted by a frequency transposition scheme that transposes frequency components from the mid frequency section M to the low frequency section L. Without applying the weighting function w before transposing the mid frequency section as input spectrum to the low frequency section L, an overlapping of significant frequency components of the mid frequency section M with the first two formants would result in an unwanted disruption resulting in discomfort for the hearing device user.

FIG. 11 shows a second spectral contour S2 representing a fricative, to which the same weighting function w is applied as the one shown in FIG. 10. The second spectral contour S2 comprises substantial energy in the high frequency section H, whereas the low frequency section L has only little energy so that—even after application of the weighting function w—the high frequency section H still remains the most important spectral section. The weighting function w can be chosen appropriately and offer a trade-off between an amount of tolerated vowel distortions and the new high frequency fricative information that needs to be transposed or lowered.

The purpose of the weighting function w is to alter the significance of the spectral information based on expectation of the hearing impaired person.

This significance measure which is obtained by multiplication of the weighting function w by the spectral energy magnitude—represented by the spectral contours S1 and S2 in FIGS. 10 and 11 is then used by the frequency transposition scheme to decide on information or frequency components that need to be transposed. Again, the weighting is only used for a selection of a corresponding frequency range in one embodiment, and only the un-weighted frequency range is transposed thereafter. In another embodiment, the weighted spectrum is transposed.

Since most hearing impaired patients are still having some usable hearing in the low frequency section L, a weighting function w according to the present invention can be chosen such that a lot of importance is given to low frequency information to keep them from getting modified (and distorted) by a frequency transposition scheme. The method according to the present invention proposes to bias a frequency transposition scheme to better match the auditory expectation of a hearing impaired user based on available hearing, whereas still leaving the door open for transposing fricatives dominated by high frequency energies. Together with a weighting function w, a frequency transposition scheme can exploit the fact that vowels are dominated by higher energies in lower frequencies, and fricatives by higher energies in the higher frequencies, to conditionally lower fricatives while leaving vowels almost untouched. This decreases the initial objections of the hearing impaired user to a frequency transposition scheme while maximizing benefit. This could be critical to acceptance of a frequency transposition algorithm for those hearing impaired users, where a cut-off frequency needs to be reduced low enough to encroach on the frequency area with significant vowel information, i.e. lower than 1'500 Hz. An assumption that the frequency transposition scheme makes is that the energy distribution of the phonemes is not significantly different for the contiguous frequencies in the most important spectral section of the phoneme, which appears to be reasonable. This is a prerequisite so that the most significant spectral section thrown up after applying the weighting function w is perceptually coherent and meaningful.

FIG. 12 shows a further example of a spectral contour S3 that is dominated by energy in the low, mid and high frequency sections L, M, H. On applying the same weighting function w—as shown in FIGS. 10 and 11—to this spectral contour S3, the most significant spectral section is still the high frequency section H, which has a higher energy than the mid frequency section M. However, this might not be the most useful frequency section for phoneme perception or discrimination, respectively. A slightly different weighting function w' which gives slightly higher weights applied in the mid frequency section M than in the high frequency section H is illustrated in FIG. 13.

Figure 13:
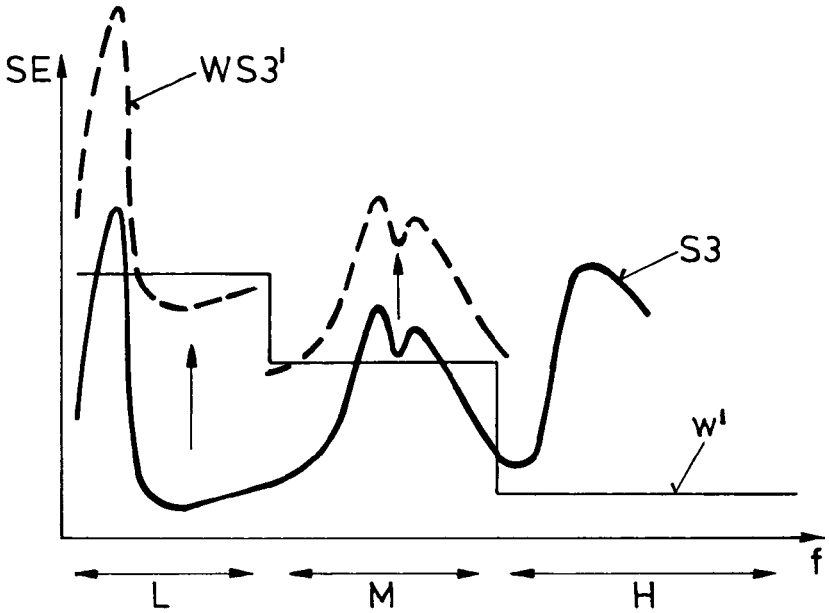
FIG. 13 shows the third spectral contour to which a weighting function is applied that scales the frequency energy in the low frequency section as well as in the mid frequency section.

One can see in FIG. 13 that the mid frequency section M has become more significant after applying the weighting function w', and can therefore be selected by a frequency transposition scheme.

Figure 14:
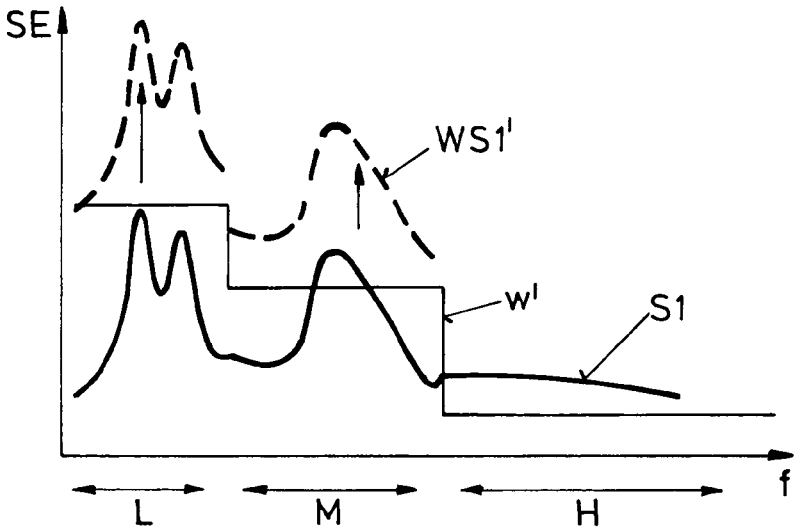
FIG. 14 shows the first spectral contour, to which the weighting function of FIG. 13 is applied.
Figure 15:
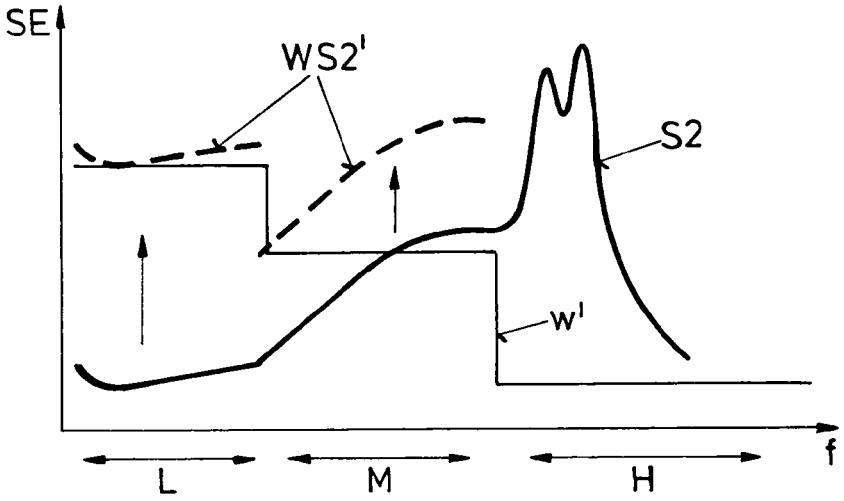
FIG. 15 shows the second spectral contour, to which also the weighting function of FIG. 13 or 14 is applied.

FIGS. 14 and 15 show that the weighting function w' does not change the significance order of the spectral sections for the vowel and the fricative spectral contours S1 and S2 shown in FIGS. 10 and 11, respectively. It is easy to recognize that one might run into conflicting requirements if one went on changing the weighting function w like this further, and there is a limit to the flexibility in designing a weighting function, imposed by the spectral energy distribution across different phonemes. There is an optimal weighting function w that depends on the hearing loss and the frequency transposition scheme applied. The advantage of the present invention is the possibility of having a very low level parameterizable trade-off between vowel distortions and useful high frequency information to be made available to a hearing impaired by means of the weighting function w'. It is a very simple way of parameterizing a frequency transposition scheme for conditional processing of speech without an explicit detection of phonemes themselves, as would be the case for a phoneme pattern recognition algorithm.

The weighting function w, w' described here can be used with all frequency transposition schemes, be it for speech or for music. However, the success of the frequency transposition will depend on the frequency transposition scheme itself. In particular, a piecewise division of the input spectrum—at least into a source region and a destination region—is important for a meaningful selection of the frequency section preferred for the transposition. Even in frequency transposition schemes that use linear frequency transposition, the proposed weighting functions w, w' can be used to protect important spectral information in the destination region from getting disrupted. One of the advantages of achieving adaptive lowering with this kind of weighting function w, w' is the ease of integration with the frequency transposition scheme itself. For example, the simple weighting functions w shown in FIGS. 10 and 11 can be implemented through a single additional parameter for the frequency transposition scheme, e.g. a frequency stacking that has been described in connection with FIGS. 3 to 9 and that will be further described in connection with FIGS. 16 and 17.

The actual values for the weight function w, w' can be used to more specifically target a given phoneme for frequency transposition in order to arrive at a trade-off between sound quality and benefit of transposed information. It is further to be noted that the simple weighting scheme described here is approximate and not exact in the sense that it just offers an easily parameterizable trade-off in a frequency transposition context between what can be transposed and the distortions that can still be tolerated, to arrive at an optimal fitting of a frequency transposition scheme for a given hearing loss.

FIGS. 9 and 10 show an example of a frequency transposition scheme that can exploit a weighting function w to conditionally lower high frequency energy while keeping low frequency distortions to a minimum. An important requirement for a frequency transposition scheme to be able to successfully exploit the weighting described herein is that it should divide a source region into meaningful pieces of perceptually significant information and separate the source region and destination regions for the frequency transposition.

The frequency transposition scheme described as a possible embodiment for a frequency lowering is called frequency stacking and has been extensively described in connection with the embodiments depicted in FIGS. 3 to 9.

Figure 16:
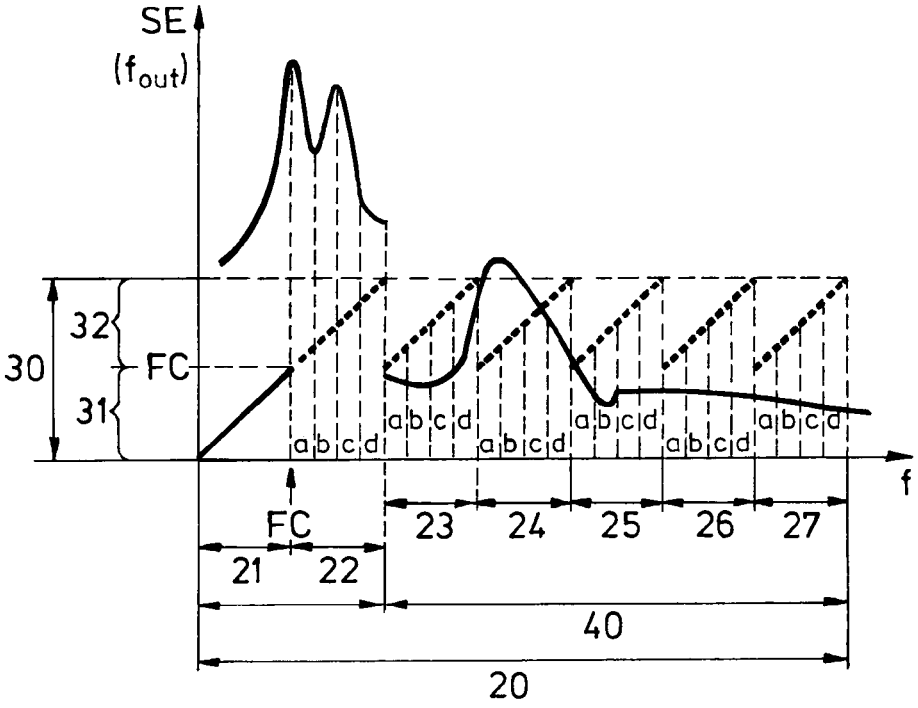
FIG. 16 shows the first spectral contour in combination with a transposition scheme based on stacking.

The frequency transposition scheme described in connection with FIG. 16 is called static frequency stacking, which is characterized by a cut-off frequency FC, dividing the source region 20. Below the cut-off frequency FC, no information is altered. Above the cut-off frequency FC, a first source stack 22 is defined lying within the source region 20. Further source stacks 23 to 27 are defined lying above the first source stack 21. In one embodiment of the present invention—as depicted in FIGS. 16 and 17, the source stacks 22 to 27 are of equal size.

The frequency transposition scheme illustrated in FIG. 16 may comprise a peak picking method that chooses peaks between the corresponding bins a, b, c, d of the source stacks 22 to 27 to construct the final processed destination stack 32. An important factor here is a stack size parameter which is assumed to be optimal for the purpose of illustration of the frequency transposition scheme. Of course, the stack size parameter may vary in a wide range to meet specific requirements.

Figure 17:
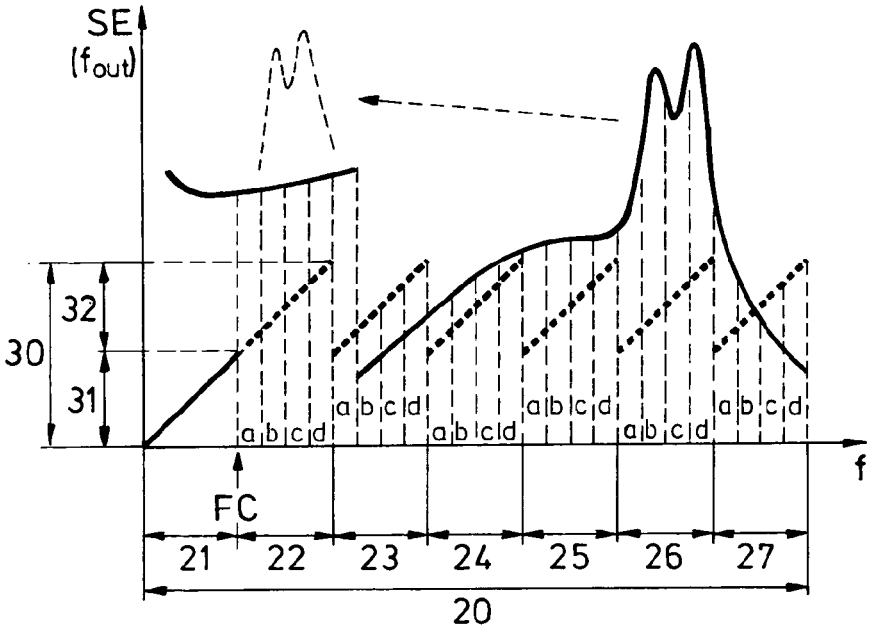
FIG. 17 shows the second spectral contour in combination with a transposition scheme based on stacking.

The two weighted spectral contours WS corresponding to a vowel (FIG. 16) and a fricative (FIG. 17), respectively, are shown with the destination stack overlaid in FIGS. 16 and 17. One can see from FIGS. 16 and 17, how the vowel information is preserved by the frequency transposition scheme and the weighting function, while the fricative information is transposed to the destination stack 32 (dashed line in FIG. 17), the transposed signal components being indicated on the x-axis in the first source stack 22 having the same frequencies as the destination stack 32.

The presented weighting functions w, w' can be used in a frequency transposition scheme to push the cut-off frequency FC further down than it is possible with state of the art algorithm. It could potentially be used in all hearing devices that use a frequency compression and where it makes sense to offer lower cut-off frequencies for a sound recover feature while managing the adaptation time and/or initial objections by hearing device users.

Figure 18:
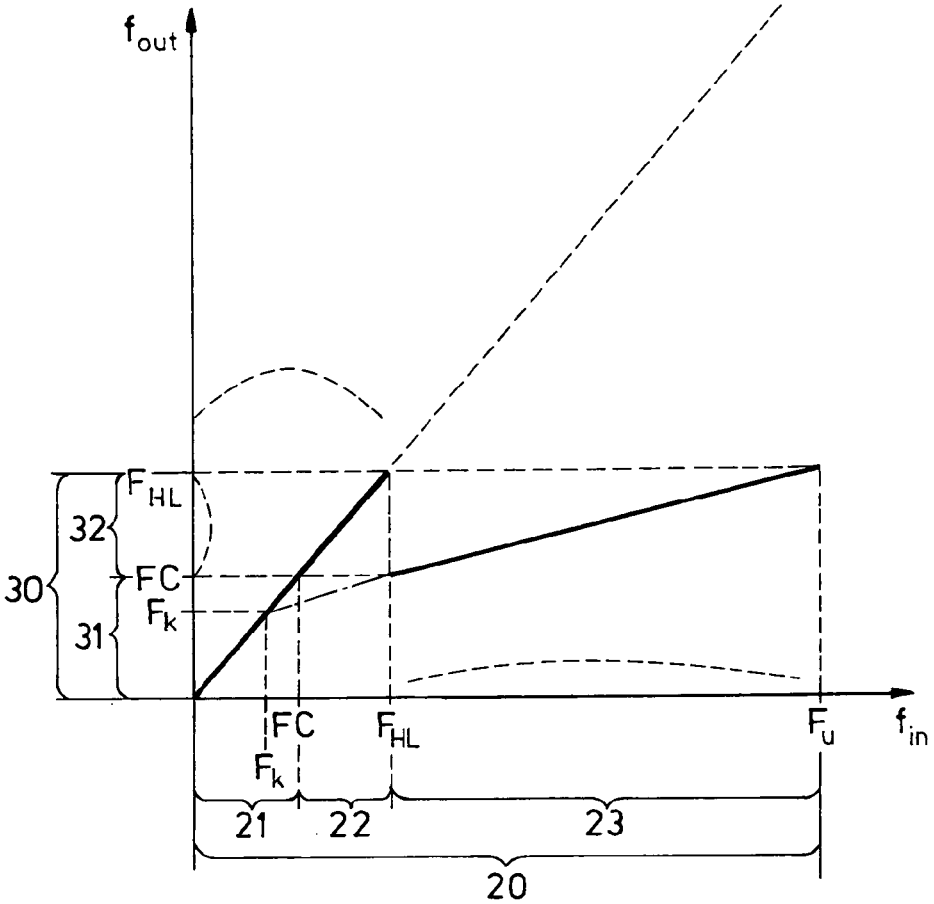
FIG. 18 shows a further graph illustrating an eight embodiment of the inventive frequency transposition scheme comprising two source stacks.

In FIG. 18, a graph is depicted illustrating a further embodiment for a transposition scheme according to the present invention.

Again, the input frequency $f_{in}$ is shown on the x-axis while the output frequency $f_{out}$ is shown on the y-axis. The x-axis as well as the y-axis has a logarithmic scale. The frequency transposition scheme according to the present invention comprises the step of copying the spectral energy in the lower source region 21 to the lower destination region 31 up to the lower cut-off frequency FC (one-to-one mapping). Furthermore, the spectral energy of a first source stack 22, which starts at the lower cut-off frequency FC and ends at a upper cut-off frequency $F_{HL}$, is—in one embodiment—also copied to a destination stack 32 (again one-to-one mapping). While the upper cut-off frequency $F_{HL}$ is ideally envisaged to be the edge of the aid-able region of hearing for the hearing device user (it is noted that the upper cut-off frequency FHL could also be higher or lower than the edge of the aid-able region of hearing), up to which upper cut-off frequency $F_{HL}$ the auditory expectations of the hearing device user need to be respected, the lower cut-off frequency FC is determined by the following equation:

$$F_k = \frac{C_R \cdot FC - F_{HL}}{C_R - 1}$$

wherein

- $C_R$ is a compression ratio in the second source stack 23 of the two source stacks 22 and 23;
- FC corresponds to the logarithm of lower cut-off frequency defined between a lower source region 21 and a first source stack 22;
- $F_{HL}$ corresponds to the logarithm of upper cut-off frequency being the lowest frequency of the second source stack 23; and
- $F_k$ corresponds to logarithm of a start frequency being defined as point of intersection between a one-to-one mapping of frequency components in the lower source region 21 and an extension of the compressive mapping of the second source stack 23.

The determination of the optimal values of parameters in the above equation for a given hearing loss could be based on audiological experiments that are described, for example, in a publication entitled "Modified Verification Approaches for Frequency Lowering Devices" by Danielle Glista & Susan Scollie (National Centre for Audiology, the University of Western Ontario, Sep. 11, 2009). This publication can be retrieved from the internet under http://www.audiologyonline.com/articles/article_detail.asp? article_id=2301.

In the frequency transposition scheme according to the present invention, the compression does not start at the lower cut-off frequency FC but at the upper cut-off frequency $F_{HL}$. The compression ends at the upper frequency $F_u$, above which no relevant information is expected. The second source stack 23—defined between the upper cut-off frequency $F_{HL}$ and the upper frequency $F_u$—is transposed as well to the destination stack 32, in which a replacement and/or superposition of spectral energy of the first source stack 22 and/or the second source stack 23 takes place. For example, a biased peak picking algorithm or a weighting function w with subsequent superposition is applied to emphasize relevant spectral information in the second source stack 23 or in the first source stack 22.

The biased peak picking method is used to respect the auditory expectation of the hearing device user and is achieved by using an appropriate spectral weighting function.

The weighting function w (again also called expectation bias) is used to adaptively choose different parts of the input spectrum—e.g. the first source stack 22 or the second source stack 23 (FIG. 18)—to transpose to the destination stack 32. The spectral energy magnitudes are multiplied by the weights of the weighting function w and this weighted spectrum can be used by a frequency transposition scheme for further processing.

The weighting function w or the expectation bias function weights the input spectrum in such a way that the already available low frequency information is given more significance. If a frequency transposition scheme then selects the most important information from a given source region 20 to be transposed to a destination region 30, auditory expectations are respected more and information is transposed only if it is considerably significant in comparison to what is already accessible to the hearing impaired user in the lower source region 21 or the lower destination region 31.

An advantage of using a weighting function w is that an adaptive lowering can be accomplished without any explicit real time detection of phonemes themselves. This is accomplished by a careful choice of weights and by exploiting the fact that fricatives have proportionally much larger energy in the higher frequencies compared to vowels. This keeps the vowels from getting distorted while still lowering high frequency information in fricatives.

The frequency transposition scheme according to this embodiment of the present invention ensures two things which are fundamentally different from the known frequency compression scheme:

First, it separates the second source stack 23 from the first source stack 22 in the frequency transposition context. The second difference is that the final output of the frequency transposition scheme in the destination stack 32 is chosen with a biased peak picking algorithm between the spectral energies of the first source stack 22 and the second source stack 23. This results in the final input/output curve becoming signal dependent unlike in the known frequency transposition scheme where a non-linear monotonic relationship between the input frequency $f_{in}$ and the output frequency $f_{out}$, as shown in FIG. 2, is implemented.

For example, the biased peak picking algorithm can be formulated as follows, wherein for a given compression ratio $C_R$ and lower cut-off frequency FC the frequency bins at (n+j), n+j+1), . . . , (n+j+k) map to the same frequency bin n:

$$i = \arg\max\,[w(n)\cdot F_{in}(n), w(n+j)\cdot F_{in}(n+j), w(n+j+1)\cdot F_{in}(n+j+1), \ldots, w(n+j+k)\cdot F_{in}(n+j+k)]$$

$$F_{out}(n) = w''(i)\cdot F_{in}(i)$$

wherein

- $F_{out}(n)$ is the output of the peak selection scheme for a given frequency bin with index n;
- w(n) is the value of the expectation bias weighting function for the $n^{th}$ frequency bin;
- w"(i) is the value of yet another weighting function for index i, used to weight the value of the transposed bin in the destination stack 32;
- argmax [ . . . ] denotes the bin index for which the expression within [ ] is maximum;
- $F_{in}(n)$ is the input magnitude for a frequency bin n.

The lower cut-off frequency of the frequency transposition scheme according to the present invention is denoted by FC and the compression ratio applied in the second source stack 23 is denoted by $C_R$.

The relationship between different parameters shown in FIG. 18 is given, for example, by the following equation:

$$F_k = \frac{C_R \cdot FC - F_{HL}}{C_R - 1}$$

The parameterization of the lower cut-off frequency FC and the compression ratio $C_R$ in the known frequency compression algorithm should ideally be dependent on the hearing loss and spectral energy distribution of speech.

The separation of the second source stack 23 and the destination stack 32 in the compression scheme, together with a biased peak picking allows for transposing energies only when they are significant compared to what is already there in the first source stack 22. This leaves the already audible harmonic structure of the vowels intact while still transposing fricatives and other phonemes dominated by high frequency energies.

As the harmonic relationship of the notes of western instrumental music is similar to vowels, the frequency transposition scheme according to the present invention also distorts music less in comparison to the known techniques.

All embodiments of the present invention allow to apply frequency transposition schemes to be extended to hearing impaired with profound hearing losses and a very limited bandwidth of aid-able hearing, by better managing the vowel distortions audible with lower cut-off frequencies in the original frequency compression scheme.

In principle the present invention can be extended for a low frequency hearing loss as well—although a low frequency hearing loss is rare but still well known—, where the auditory expectation bias or weighting function is derived from accessible high frequencies.

What is claimed is:

1. A method for operating a hearing device by applying a frequency transposition scheme to an input signal (i) of the hearing device comprising an input transducer (1), a signal processing unit (3) and an output transducer (5), the method comprising the steps of:

transforming the input signal (i) from time domain into frequency domain by applying a transformation function in order to obtain an input spectrum having a frequency range comprising a source region (20) and a destination region (30), adaptively selecting signal components of the source region (20) taking into account momentary characteristics of the input signal (i), transposing the selected signal components to the destination region (30), and supplying an output spectrum or a transformation thereof to the output transducer (5), the output spectrum comprising signal components of the destination region (30), wherein the source region (20) comprises a lower source region (21) and at least two source stacks (22, . . . , 26), the lower source region (21) being below a cut-off frequency (FC) and the at least two source stacks (22, . . . , 26) being above the cut-off frequency (FC), and wherein the destination region (20) comprises a lower destination region (31) and a destination stack (32), the lower destination region (31) being below the cut-off frequency (FC) and the destination stack (32) being above the cut-off frequency (FC), the cut-off frequency (FC) particularly being below 1,500 Hz, and wherein one of the source stacks (22, . . . , 26) is selected and transposed to the destination stack (32) by either replacing an original frequency content of the destination stack (32) with a frequency content of the selected source stack (22, . . . , 26) or combining the original frequency content of the destination stack (32) with the frequency content of the selected source stack (22, . . . , 26).

2. The method of claim 1, wherein the momentary characteristic is at least one of the following:

an auditory expectation of the user of the hearing device;

a momentary energy distribution in the source region (20), in particular the momentary energy distribution of phonemes in the source region (20);

a momentary energy distribution in the destination region (30);

a perturbation signal being present in the input signal (i).

3. The method according to claim 1, wherein the step of transposing comprises the following steps:

determining a center frequency bin lying within the source region (20), a spectral energy being maximal at the center frequency bin, and transposing frequency bins equally distributed around the center frequency bin to the destination region (30).

4. The method according to claim 1, wherein the source region (20) above the cut-off frequency (FC) is divided into equally sized source stacks (22, . . . , 26), each having a frequency range that is equal to a frequency range of the destination stack (32).

5. The method according to claim 4, wherein the step of transposing comprises one of the following steps:

transposing frequency bins of the source stacks (22, . . . , 26) to corresponding frequency bins of the destination stack (32), the frequency bin being transposed having maximum energy of all corresponding frequency bins of the source stacks (22, . . . , 26);

transposing all frequency bins of one of the source stacks (22, . . . , 26) to the destination stack (32), the transposed source stack (22, . . . , 26) comprising a frequency bin having maximum energy;

transposing all frequency bins of one of the source stacks (22, . . . , 26) to the destination stack (32), the transposed source stack (22, . . . , 26) comprising a maximum energy sum over its frequency bins;

transposing all frequency bins of one of the source stacks (22, . . . , 26) to the destination stack (32), the transposed source stack (22, . . . , 26) preserving a maximum spectral contrast.

6. The method of claim 1, further comprising the step of applying a pre-weighting function (w, w') to signal components of the source region (20) before the step of adaptively selecting signal components of the source region (20).

7. The method of claim 6, wherein the pre-weighting function (w, w') is based on at least one of the following criterions:

an auditory expectation of the user of the hearing device;

a momentary energy distribution in the source region (20);

a momentary energy distribution in the destination region (30);

a perturbation signal being present in the input signal (i).

8. The method of claim 1, further comprising the step of applying a post-weighting function (w") to the destination region (30) after the step of transposing the selected signal components.

9. The method of claim 8, wherein the steps of selecting and transposing comprise a peak picking according to the following scheme:

$$i=\arg\max\,[w(n)\cdot F_{in}(n), w(n+j)\cdot F_{in}(n+j), w(n+j+1)\cdot F_{in}(n+j+1), \ldots, w(n+j+k)\cdot F_{in}(n+j+k)]$$

$$F_{out}(n)=w''(i)\cdot F_{in}(i)$$

wherein $F_{out}(n)$ is the output of the peak selection scheme for a given frequency bin with index n;

w(n) is the value of a pre-weighting function for the $n^{th}$ frequency bin;

w"(i) is the value of a post-weighting function for index i, used to weight the value of the transposed bin in destination region;

argmax [ . . . ] denotes the bin index for which the expression within [ ] is maximum; and $F_{in}(n)$ is the input magnitude for a frequency bin n.

10. The method of claim 1, wherein the frequency transposition scheme is defined by the following formula:

$$F_k = \frac{C_R \cdot FC - F_{HL}}{C_R - 1}$$

wherein $C_R$ is the compression ratio in a second source stack (23) of two source stacks (22, 23);

FC corresponds to logarithm of the cut-off frequency defined between a lower source region (21) and first source stack (22);

$F_{HL}$ corresponds to logarithm of an upper frequency being the lowest frequency of the second source stack (23); and $F_k$ corresponds to logarithm of a start frequency being defined as point of intersection between a one-to-one mapping of frequency components in the lower source region (21) and an extension of the compressive mapping of the second source stack (23).

11. A hearing device comprising:

an input transducer (1), an output transducer (5), and a signal processing unit (3) being operatively connected to the input transducer (1) as well as to the output transducer (5) and configured to:

transform the input signal (i) from time domain into frequency domain by applying a transformation function in order to obtain an input spectrum having a frequency range comprising a source region (20) and a destination region (30), adaptively select signal components of the source region (20) taking into account momentary characteristics of the input signal (i), transpose the selected signal components to the destination region (30), and supply the output spectrum or a transformation thereof to the output transducer (5), the output spectrum comprising signal components of the destination region (30), wherein the source region (20) comprises a lower source region (21) and at least two source stacks (22, . . . , 26), the lower source region (21) being below a cut-off frequency (FC) and the at least two source stacks (22, . . . , 26) being above the cut-off frequency (FC), and wherein the destination region (20) comprises a lower destination region (31) and a destination stack (32), the lower destination region (31) being below the cut-off frequency (FC) and the destination stack (32) being above the cut-off frequency (FC), the cut-off frequency (FC) particularly being below 1,500 Hz, and wherein the signal processing unit (3) is configured to select and transpose one of the source stacks (22, . . . , 26) to the destination stack (32) by either replacing an original frequency content of the destination stack (32) with a frequency content of the selected source stack (22, . . . , 26) or combining the original frequency content of the destination stack (32) with the frequency content of the selected source stack (22, . . . , 26).

12. The hearing device of claim 11, wherein the momentary characteristic is at least one of the following:

an auditory expectation of the user of the hearing device;

a momentary energy distribution in the source region (20), in particular the momentary energy distribution of phonemes in the source region (20);

a momentary energy distribution in the destination region (30);

a perturbation signal being present in the input signal (i).

13. The hearing device according to claim 11, wherein to transpose the selected signal components, the signal processing unit (3) is further configured to:

determine a center frequency bin lying within the source region (20), a spectral energy being maximal at the center frequency bin, and transpose frequency bins equally distributed around the center frequency bin to the destination region (30).

14. The hearing device according to claim 11, wherein the source region (20) above the cut-off frequency (FC) is divided into equally sized source stacks (22, . . . , 26), each having a frequency range that is equal to a frequency range of the destination stack (32).

15. The hearing device according to claim 14, wherein to transpose the selected signal components, the signal processing unit (3) is further configured to:

transpose frequency bins of the source stacks (22, . . . , 26) to corresponding frequency bins of the destination stack (32), the frequency bin having maximum energy of all corresponding frequency bins of the source stacks (22, . . . , 26);

transpose all frequency bins of one of the source stacks (22, . . . , 26) to the destination stack (32), the transposed source stack (22, . . . , 26) comprising a frequency bin having maximum energy;

transpose all frequency bins of one of the source stacks (22, . . . , 26) to the destination stack (32), the transposed source stack (22, . . . , 26) comprising a maximum energy sum over its frequency bins; and transpose all frequency bins of one of the source stacks (22, . . . , 26) to the destination stack (32), the transposed source stack (22, . . . , 26) preserving a maximum spectral contrast.

16. The hearing device of claim 11, wherein the signal processing unit (3) is further configured to apply a pre-weighting function (w, w') to signal components of the source region (20) before adaptively selecting signal components of the source region (20).

17. The hearing device of claim 11, wherein the signal processing unit (3) is further configured to apply a post-weighting function (w") to the destination region (30) after transposing the selected signal components.

* * * * *